US010060228B2

(12) United States Patent
Smith et al.

(10) Patent No.: US 10,060,228 B2
(45) Date of Patent: Aug. 28, 2018

(54) PSEUDO PHASE PRODUCTION SIMULATION: A SIGNAL PROCESSING APPROACH TO ASSESS QUASI-MULTIPHASE FLOW PRODUCTION VIA SUCCESSIVE ANALOGOUS STEP-FUNCTION RELATIVE PERMEABILITY CONTROLLED MODELS IN RESERVOIR FLOW SIMULATION IN ORDER TO RANK MULTIPLE PETRO-PHYSICAL REALIZATIONS

(71) Applicant: Landmark Graphics Corporation, Houston, TX (US)

(72) Inventors: Trace Boone Smith, Lafayette, LA (US); Travis St. George Ramsay, Rosenberg, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 164 days.

(21) Appl. No.: 14/894,971

(22) PCT Filed: Sep. 16, 2013

(86) PCT No.: PCT/US2013/059983
§ 371 (c)(1),
(2) Date: Nov. 30, 2015

(87) PCT Pub. No.: WO2015/038162
PCT Pub. Date: Mar. 19, 2015

(65) Prior Publication Data
US 2016/0177681 A1 Jun. 23, 2016

(51) Int. Cl.
*E21B 43/00* (2006.01)
*E21B 49/00* (2006.01)

(52) U.S. Cl.
CPC ..... *E21B 43/00* (2013.01); *E21B 49/00* (2013.01)

(58) Field of Classification Search
CPC ..... E21B 43/00; E21B 49/00
See application file for complete search history.

(56) References Cited

U.S. PATENT DOCUMENTS 8,131,526 B2 * 3/2012 Neville ..... E21B 49/00 703/10
9,790,770 B2 * 10/2017 King ..... E21B 43/00
(Continued)

FOREIGN PATENT DOCUMENTS

WO WO2015038163 A1 3/2015

OTHER PUBLICATIONS

International Search Report and Written Opinion, dated Jun. 19, 2014, 9 pages, Korean International Searching Authority.

*Primary Examiner* — Nicholas Tobergte

(57) ABSTRACT

The disclosed embodiments include a method, apparatus, and computer program product for approximating multi-phase flow reservoir production simulation for ranking multiple petro-physical realizations. One embodiment is a system that includes at least one processor and memory coupled to the at least one processor, the memory storing instructions that when executed by the at least one processor performs operations that includes generating a set of pseudo-phase production relative permeability curves; receiving production rate history data; receiving minimal simulation configuration parameters; performing flow simulation using the set of pseudo-phase production relative permeability curves for a set of petro-physical realizations; determining an optimal matching pseudo-phase production simulation result that best matches the production rate history data; and determining a ranking for the petro-physical realizations within the
(Continued)

set of petro-physical realizations based on an area between a composite rate curve for a petro-physical realization and a historical rate curve.

20 Claims, 9 Drawing Sheets

(56) References Cited

U.S. PATENT DOCUMENTS

| | | | | |
|---|---|---|---|---|
| 2010/0071897 | A1 | 3/2010 | Liu et al. | |
| 2010/0185393 | A1 | 7/2010 | Liang et al. | |
| 2012/0253770 | A1 | 10/2012 | Stern et al. | |
| 2013/0096899 | A1 | 4/2013 | Usadi et al. | |
| 2015/0073762 | A1* | 3/2015 | Patacchini | E21B 43/16 703/10 |
| 2015/0120255 | A1* | 4/2015 | King | E21B 43/00 703/2 |
| 2016/0177681 | A1* | 6/2016 | Smith | E21B 49/00 703/10 |

* cited by examiner

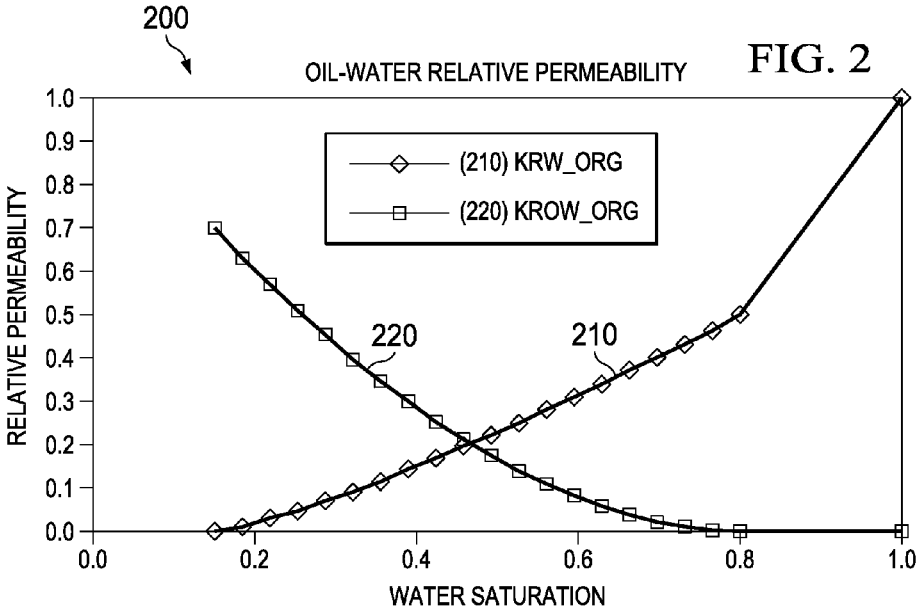
FIG. 3
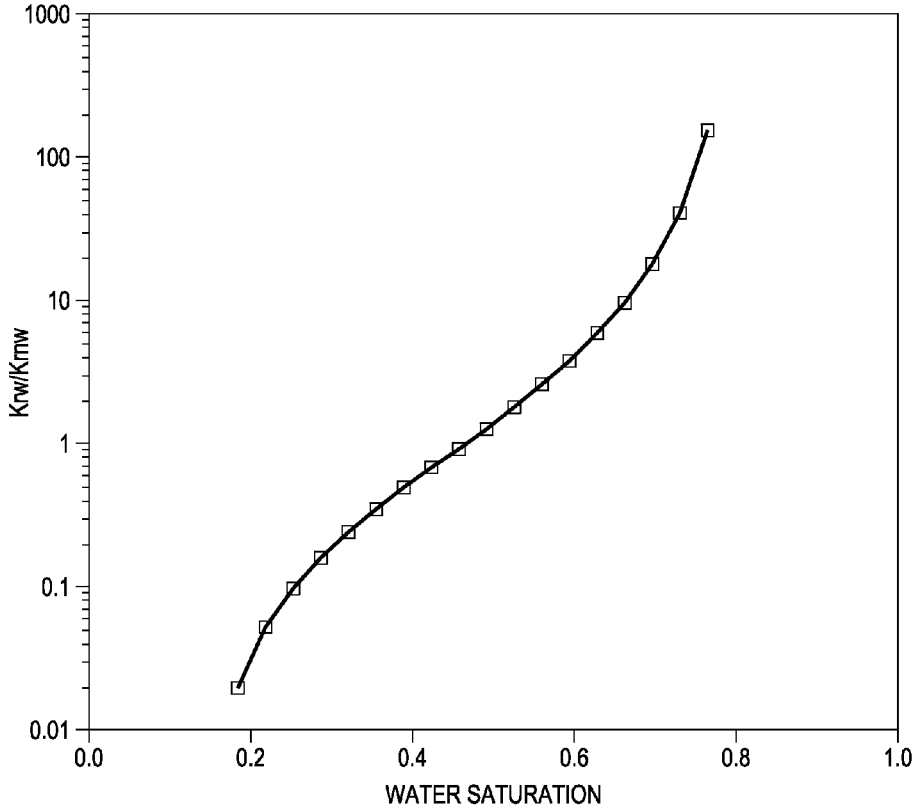

PSEUDO PHASE PRODUCTION SIMULATION: A SIGNAL PROCESSING APPROACH TO ASSESS QUASI-MULTIPHASE FLOW PRODUCTION VIA SUCCESSIVE ANALOGOUS STEP-FUNCTION RELATIVE PERMEABILITY CONTROLLED MODELS IN RESERVOIR FLOW SIMULATION IN ORDER TO RANK MULTIPLE PETRO-PHYSICAL REALIZATIONS

CROSS-REFERENCE TO RELATED APPLICATIONS

This application is a U.S. National Stage patent application of International Patent Application No. PCT/US2013/059983, filed on Sep. 16, 2013, the benefit of which is claimed and the disclosure of which is incorporated herein by reference in its entirety.

BACKGROUND OF THE INVENTION

1. Field of the Invention

The present invention generally relates to the field of computerized reservoir modeling, and more particularly, to a system and method configured to approximate multiphase flow simulation using one or more pseudo-phase single flow relative permeability curves for ranking multiple petro-physical realizations.

2. Discussion of the Related Art

Reservoir modeling and numerical simulation involving multiphase flows (i.e., flows where more than two phases (e.g., water and oil) are present) through a porous medium poses far greater challenges than that of single-phase flows due in part to interfaces between phases. Due to the overall complexity of multiphase flow simulation, the time needed to simulate multiphase flows are substantially greater than its single phase counterpart. In addition, simulation of multiphase flows requires a greater understanding of fluid property characteristics to accurately model the complex fluid system.

Accordingly, the disclosed embodiments seek to provide one or more solutions for one or more of the above problems associated with reservoir modeling involving multiphase flows.

BRIEF DESCRIPTION OF THE DRAWINGS

Illustrative embodiments of the present invention are described in detail below with reference to the attached drawing figures, which are incorporated by reference herein and wherein:

FIG. 2 illustrates an example of a drainage oil-water relative permeability curve in accordance with the disclosed embodiments;

FIG. 3 illustrates an example of a relative permeability ratio curve in accordance with the disclosed embodiments;

DETAILED DESCRIPTION

The disclosed embodiments include a system, computer program product, and a computer implemented method configured to perform a pseudo-phase production simulation. Pseudo-phase as referenced herein means approximating two or more phase (i.e., multiphase) flow using a single phase flow. A purpose of pseudo-phase production simulation is to extend the application of single phase flow simulation as an efficient means of predicting actual multiphase reservoir production in order to rank multiple realizations. For example, in certain embodiments, viscosity ratio invariant relative permeability curves are used to validate the ranking of multiple stochastic petro-physical realizations with respect to the actual field production history for an oil-water model. Additionally, the disclosed embodiments seek to treat relative permeability curves, which are input into a reservoir simulator to describe fluid-fluid and fluid-rock interaction, as a synthesized signal to approximate different flow regimes which may exist during production; then use this approximation to validate a given static model with respect to production history.

One advantage of the disclosed embodiments is that it would diminish run times as compared to the run times for performing multiphase flow production simulation. In addition, the disclosed embodiments decrease the complexity and knowledge needed to provide a comparison of general flow modeling relative to production history for the non-esoteric user.

The disclosed embodiments and additional advantages thereof are best understood by referring to FIG. 1A through FIG. 10 of the drawings, like numerals being used for like and corresponding parts of the various drawings. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

Figure 1A:
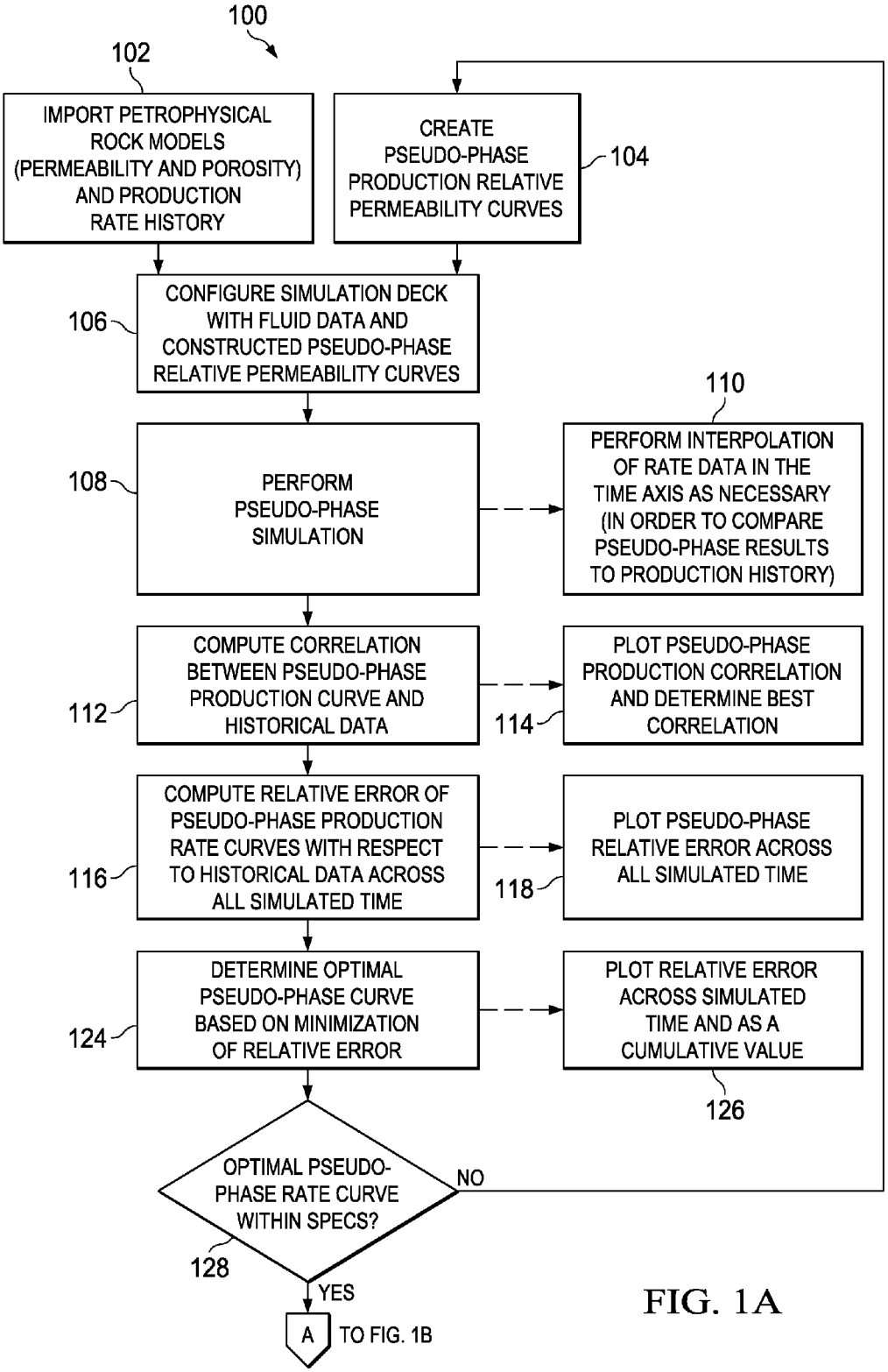
FIGS. 1A and 1B is a flowchart that illustrates an example of a process for approximating multiphase flow in accordance with the disclosed embodiments.

Beginning with FIG. 1A, an example of a computer implemented method/process 100 for approximating multiphase flow in accordance with the disclosed embodiments is presented. The process 100 begins at step 102 by importing/receiving one or more petro-physical rock models (also commonly referred to as earth models) and production history data.

In one embodiment, the earth models comprise three dimensional (3D) volumes/cells that include assigned values describing the physical and chemical rock properties and their interactions with fluid. For example, in one embodiment, the assigned values include a permeability value and a porosity value associated with the rock type. The earth models may be generated using software such as, but not limited to, DecisionSpace® Earth Modeling software available from Landmark Graphics Corporation. In accordance with the disclosed embodiments, multiple earth models are cosimulated (i.e., multiple realizations of the earth model is generated with slightly different property values, e.g., porosity and permeability values are different for each realization). For example, in one embodiment, P10, P50, and P90 realizations are used. P90 refers to proved reserves, P50 refers to proved and probable reserves and P10 refers to proved, probable and possible reserves.

As stated above, at step 102, the process 100 also receives production history data such as, but not limited to, production rate data. The amount of production history data may vary from several months to several years. In one embodiment, the reservoir production history data represents a time domain feature that is processed as a time dependent signal with components of varying frequency for analyzing the time domain data to determine the existence of flow regimes. Additionally, in some embodiments, the process is configured to identify the componentization of flow behavior according to spectral qualities that exist in the resulting production during signal processing.

In addition, at step 104, the process 200 includes creating one or more pseudo-phase production relative permeability ($K_r$) curves that describe fluid-fluid and fluid-rock interaction. Permeability is the ability for fluids to flow in porous media. In multiphase flow, the relative permeability of a phase is a measure of dependent ratio of effective permeability of that phase to absolute permeability with respect to an independent measure of saturation variation that varies with time ($K_r = K_{effective}/K_{absolute}$).

An example of a relative permeability curve 200 is illustrated in FIG. 2. In particular, the relative permeability curve 200 is a drainage oil-water relative permeability curve. While water saturation is expressed as the independent axis, it is in fact a proxy for time. This is demonstrated in the Buckley-Leverett transport equation, which is used to model two-phase flow in porous media. The Buckley-Leverett equation is expressed as:

$$\frac{\partial S}{\partial t} = U(S)\frac{\partial S}{\partial x}$$

where $$U(S) = \frac{Q}{\varphi A}\frac{df}{dS}$$

Here, S(x, t) is the water saturation, f is the fractional flow rate, Q is the total flow, φ is porosity and A is the area of the cross-section in the porous media.

The relative permeability curve 200 depicts a drainage two-phase system where a non-wetting fluid (oil) phase displaces a present wetting (water) phase in the porous media. The porous medium is initially saturated with water and then via a displacement process triggered by injection of an oil phase into the porous medium, the water saturation (i.e., the relative volume of water present) decreases as the volume of oil increases. At the terminus of the relative permeability curve 200, water saturation is approximately 0.15 (or 15%), which is referred to as the irreducible water saturation (or Swirr). Thus, relative permeability changes with time due to changes in saturation of one fluid phase relative to another. This relationship may expressed using the following formula:

$$S_w(t) \rightarrow kr_{w,nw}(S_w, t)$$

where '$S_w$' is water saturation, 'kr' is relative permeability, the 'w' subscript refers to wetting fluid phase, the 'nw' subscript refers to non-wetting fluid phase, and 't' is time.

A profile of water saturation with time is typically derivable from the core/plug flooding experiment performed during special core analysis (SCAL or SPCAN) to generate the relative permeability curves. Special core analysis is a laboratory procedure for conducting flow experiments on core plugs taken from a petroleum reservoir. In particular, special core analysis includes measurements of two-phase flow properties, determining relative permeability, and capillary pressure and resistivity index using cores, slabs, sidewalls or plugs of a drilled wellbore. The derived relative permeability and capillary pressure act as input into a reservoir simulator to describe multiphase flow in the subsurface porous media and allow the simulation of fluids in the media with the requisite purpose of matching simulation to historical production data and forecasting future production. The process of special core analysis has been known to take upwards of eighteen to twenty-four months and results are not typically guaranteed due to procedural errors/inaccuracies as well as other risks associated with conducting invasive experiments on physical objects (cores, plugs, etc.).

Based on the above limitations associated with performing special core analysis, the disclosed embodiments provide an alternative method for determining a profile of relative permeability for a given rock type in the absence of relative permeability being measured in a core/sidewall/plug (i.e., derived from special core analysis). For instance, the disclosed embodiments propose the use of a novel method, referred herein as pseudo-phase production, to approximate multiphase flow using a single phase flow by sampling disparate instances of relative permeability at determined periods of stable fluid saturation. In particular, in one embodiment, a computer implemented method is disclosed that approximates different instances of relative permeability, for a given saturation, by simulating flow in a staged approach (i.e., flow one phase at a time while inhibiting the motion of the other phase)—hence creating a pseudo-phase simulation. In other words, two fluid phases would exist in the system, but only one fluid phase is in motion at a given instant.

In one embodiment, the disclosed embodiments utilize discrete, non-physical, relative permeability curves to approximate fluid flow using a collection of step-function relative permeability curves in which an increasing crossover point is defined at different instance of water saturation (also referred to herein as a pseudo-phase curves). The step-function relative permeability curves represent flow of a single phase in the presence of another immobile fluid phase. The step-function relative permeability curves have abrupt changes in relative permeability at a cross-over point where the mobile fluid becomes immobile and the initially immobile fluid becomes mobile (i.e., location in curve where ratio of relative permeability (krw/krnw) is equal to 1). An example illustration of the relative permeability ratio (krw/krnw) for the curves in FIG. 2 is shown as a logarithmic plot in FIG. 3, where 'w' refers to the water phase, which is wetting, and 'nw' refers to the oil phase which is the non-wetting phase.

Figure 4:
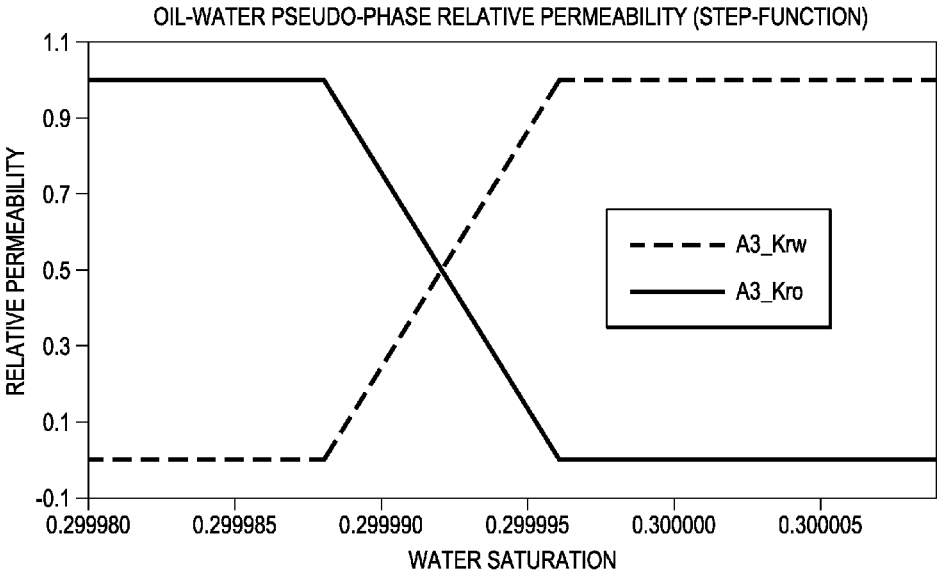
FIG. 4 illustrates an example of a step-function/pseudo-phase relative permeability curve in accordance with the disclosed embodiments.

In one embodiment, the step-function relative permeability curves are created in the form of an analog flow system. Multiple curves are generated with respective cross-over points occurring at various saturation intervals to approximate flow. An example step-function sampling curve/pseudo-phase curve is illustrated in FIG. 4. Each plotted line represents the individual pseudo-phase production relative permeability (A3, A4, A5 . . . ) and the case number is increasing as the cross-over point at a given water saturation is shifting from left to right. Although the plots appears vertical due to the scale of the graph, the crossover of $K_{ro}$ and $K_{rw}$ for each of the curves occur at a distinct point as illustrated in FIG. 4.

Figure 5:
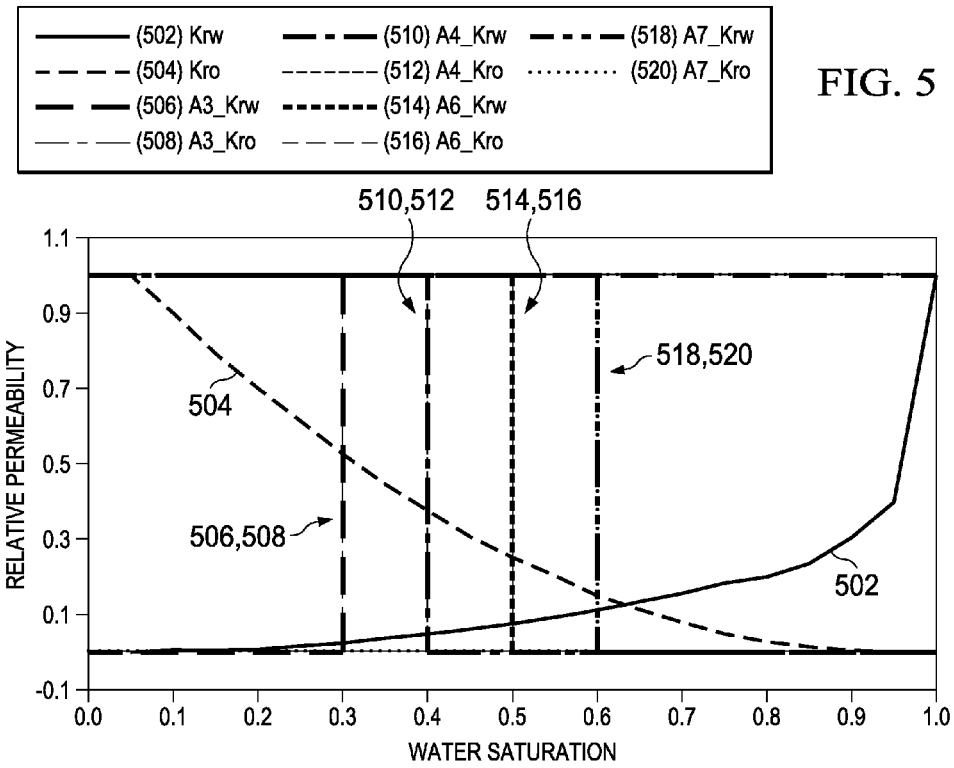
FIG. 5 is an example of an oil-water relative permeability curve that illustrates an underlying original relative permeability being displayed with several pseudo-phase relative permeability curves that are used in the pseudo-phase simulation to approximate two phase flow through single "pseudo" phases in accordance with the disclosed embodiments.

In some embodiments, multiple step-function relative permeability curves are generated with respective cross-over points occurring at various saturation intervals. The disclosed embodiments then uses the collection of corresponding step-function relative permeability curves, with cross-over locations at varying points along the original relative permeability curve to sample multiphase flow in a water-oil modeled system. For example, FIG. 5 illustrates selected sampling pseudo-phase relative permeability curves (506-520) relative to an original relative permeability curve (502 and 504). In the depicted embodiment, the illustrated pseudo-phase curves were used in the execution of subsequent simulations; whereby each executed simulation uses each of the pseudo-phase curves respectively.

Referring back to FIG. 1, once the pseudo-phase curves are generated, the process, at step 106, imports the pseudo-phase curves as a synthesized signal into a reservoir simulation application, such as, but not limited to, Nexus® Reservoir Simulation software available from Landmark Graphics Corporation, for performing flow simulation. Additionally, the process receives simulation configuration parameters such as, but not limited to, grid properties (e.g., grid cell size and total number of cells simulated), reservoir model type (e.g., oil/water), simulated time period, number of producing wells and water injector wells along with rate and pressure constraints, initial Pressure-Volume-Temperature (PVT) conditions, and phase contact depth.

Figure 6:
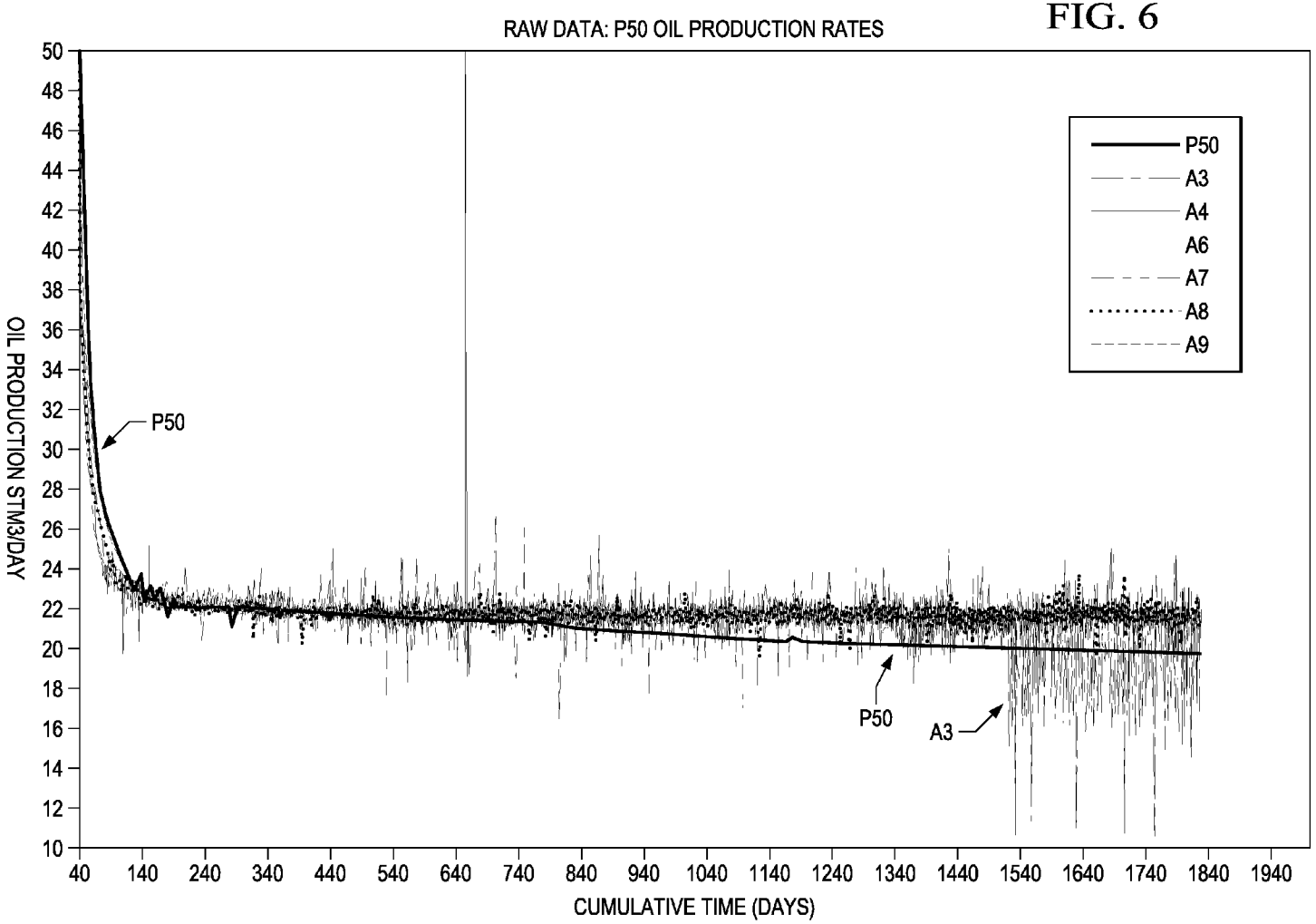
FIG. 6 is an example of a graph that illustrates a historical oil production rate curve plotted with respect to the raw (non-interpolated) oil production rate plots resulting from disparate pseudo phase simulation runs in accordance with the disclosed embodiments.

Once the parameters are configured, the process performs pseudo-phase simulation on the plurality petro-physical realizations (e.g., P90, P50, and P10) at step 108. In one embodiment, the process outputs the resulting oil production rate plots from the pseudo-phase models juxtaposed with respect to the historical production. For example, FIG. 6 illustrates the raw oil production rate results from the flow simulations that are construed using KRW_ORG and KRO_ORG from FIG. 2 as the sole input for relative permeability. The historical oil production rate curve P50 is illustrated relative to raw (non-interpolated) oil production rate plots resulting from disparate pseudo-phase simulation runs. As depicted in FIG. 6, prior to 1,826 days of cumulative time the modeled reservoir remains in single phase depletion given the equivalence in oil production rate of the original (historical) run with respect to the resulting pseudo phase run generated runs. The A3 pseudo-phase occurs at an early cross-over point, water saturation 0.299 (as illustrated in FIG. 5), and contains a higher degree of oscillations at later time steps (as illustrated in FIG. 6) in contrast to the additional pseudo-runs, which have a cross-over at higher water saturations.

Figure 7:
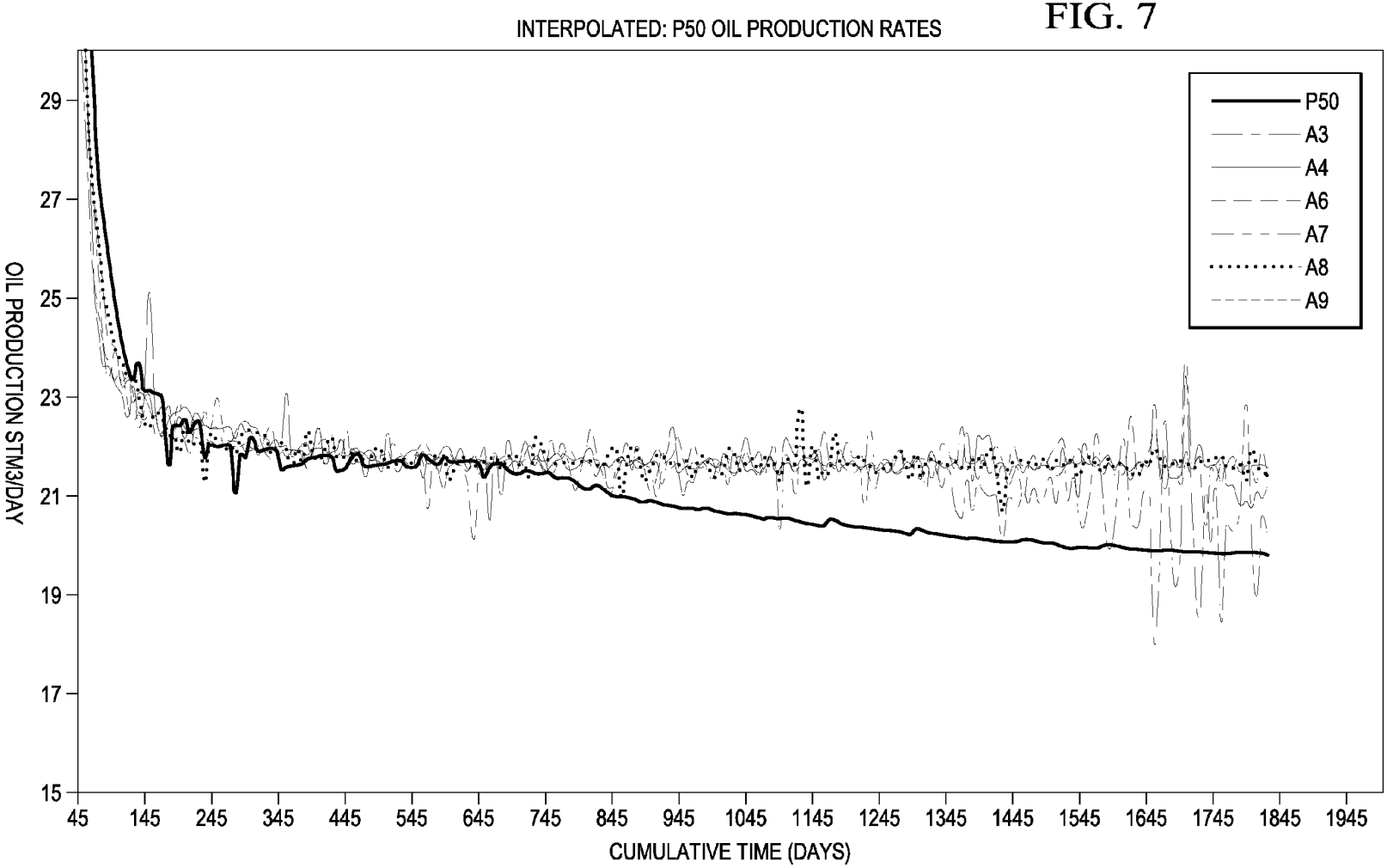
FIG. 7 is an example of a graph that illustrates a historical oil production rate curve shown relative to time-interpolated oil production rate plots resulting from disparate pseudo-phase simulation runs in accordance with the disclosed embodiments.

In some embodiments, the process at step 110 performs interpolation of rate data in the time axis as necessary in order to compare pseudo-phase results to production history. Interpolation is a method of constructing new data points within the range of a discrete set of known data points so that there is consistency among the results. For example, in the depicted embodiment, data points were linearly interpolated between the P50 base case and simulated pseudo-production so that each pseudo-phase has the same number of time steps in order to compare and analyze each pseudo-phase. For example, FIG. 7 shows time interpolated oil production rate plots such that all oil production rate plots have an identical discretization of time. The historical oil production rate curve P50 is depicted relative to time-interpolated oil production rate plots resulting from disparate pseudo-phase simulation runs.

In order to assess the relationship of the position of the relative permeability cross-over for each pseudo-phase production relative permeability curves, the process at step 112 computes the correlation coefficient of each pseudo-phase production oil rate curve relative to the historical production for each realization. For example, in one embodiment, the process at step 114 may plot the pseudo-phase production correlation to determine the best correlation. In the example used to generate the plots depicted in FIGS. 6 and 7, the results (displayed in the below tables) indicate that P90 A3 had the highest correlation and the lowest area for cumulative oil.

| A3 | A7 | A9 |
|---|---|---|
| P50 Correlation (Oil Rate) | | |
| 0.99688210 | 0.99744870 | 0.99928209 |
| P10 Correlation (Oil Rate) | | |
| 0.99760645 | 0.99784989 | 0.99870182 |
| P90 Correlation (Oil Rate) | | |
| 0.99679661 | 0.99900968 | 0.99923592 |

At step 116, the process then computes the relative error to determine the difference between production rates at given instances of time with respect to the base P50 case. In the embodiment where the pseudo-phase simulated production was interpolated; the process determines the relative difference by calculating the error between the actual history, P50, and the interpolated pseudo-phases for each realization. In certain embodiments, the process, at step 118, may optionally generate a graph 900, as illustrated in FIG. 8, which illustrates the relative difference shown between individual pseudo-phase P50 oil rates as a function of time with respect to historical simulation data.

Figure 8:
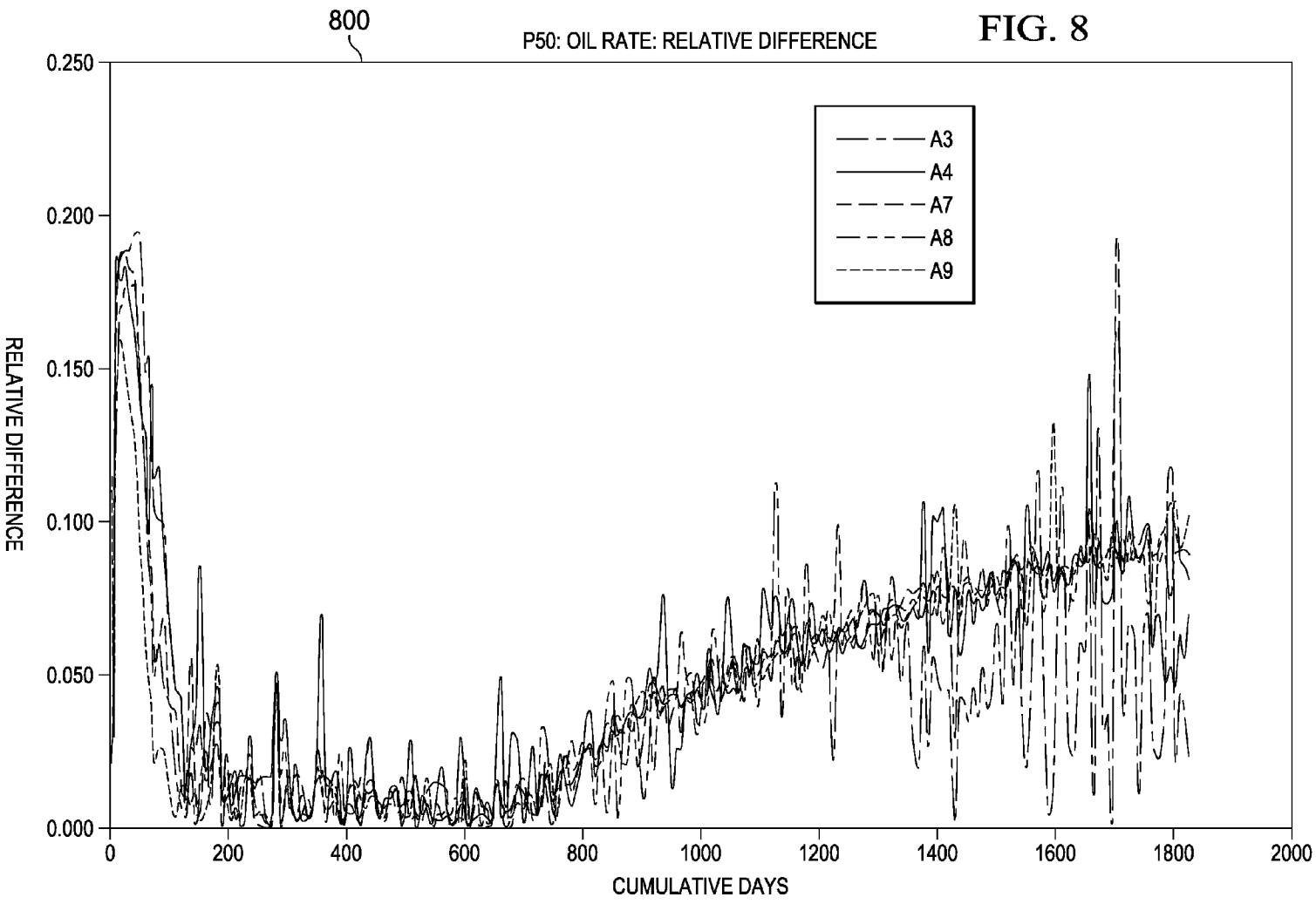
FIG. 8 is an example of a chart that illustrates relative difference between individual pseudo-phase production oil rate results with respect to historical simulation data in accordance with the disclosed embodiments.

Additionally, in certain embodiments, the process at step 124 may calculate the area under each curve across all simulated time in FIG. 8 (e.g., using the Trapezoid Rule) to determine the optimal pseudo-phase curve that best approximates historical production by the minimization of error in oil production rate and cumulative oil. In other embodiments, the process may utilize a defined integral function to determine the area under each curve. In one embodiment, the process determines a total error as a singular value to identify the pseudo-phase production curve that has minimum error with respect to the historical production rates. For instance, in some embodiments, the process may at step 126 generate one or more graphs that plot relative error across simulated time and as a cumulative value.

At step 124, the process determines whether the difference between the optimal pseudo-phase curve and the historical production rates determined in the previous steps is within a user-defined error threshold. In other words, a user may define how large of an error may exist between the determined optimal pseudo-phase curve in comparison to the historical data. For instance, if the error between the optimal pseudo-phase curve and the historical production rates exceeds the user-defined error threshold, then a determination is made that there is no good correlation between the pseudo-phase curves with respect to the historical production rates (i.e., the particular pseudo-phase runs do not approximate any instance of production from the particular reservoir). In one embodiment, if the error between the optimal pseudo-phase curve and the historical production rates exceeds the user-defined error threshold, the process returns to step 104 and creates new pseudo-phase production relative permeability curves and repeats the process 100. In one embodiment, if the error between the optimal (best matching) pseudo-phase curve with respect to the historical production rates is within the user-defined error threshold, the process may combine the production rate curves to create one or more of a composite, average, and weighted average curves that provide a description of production rate through the union of pseudo-phase relative permeability curves.

Figure 1B:
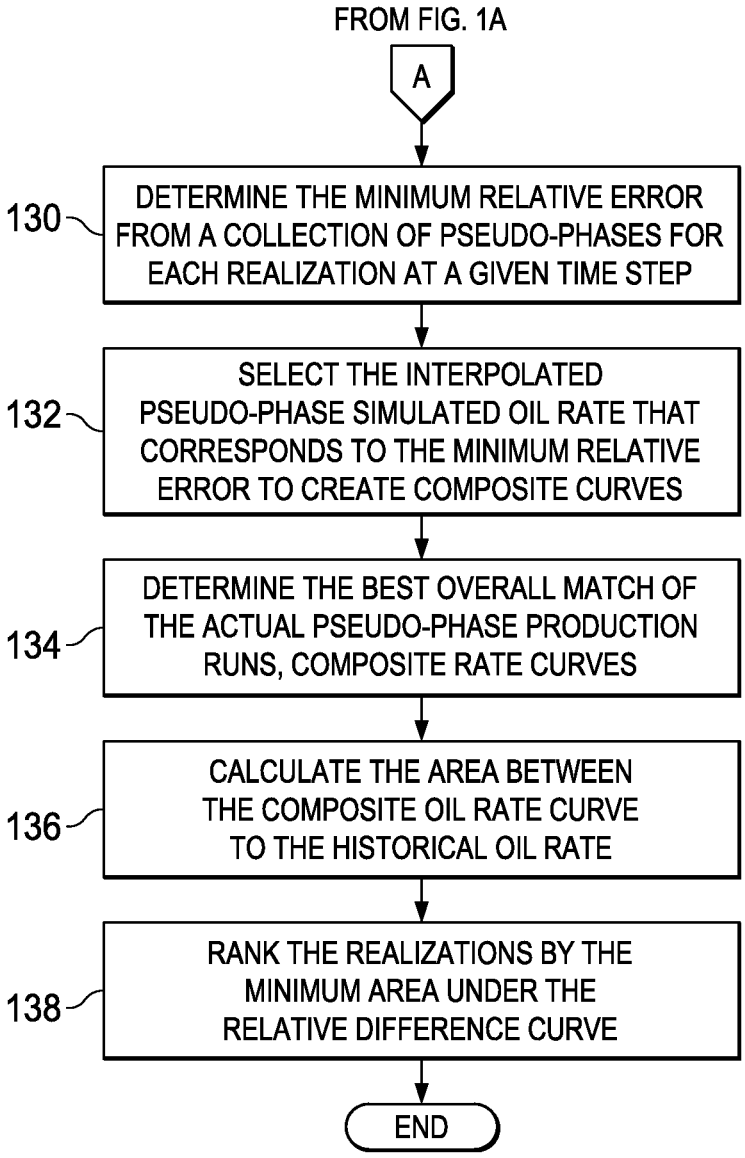

For example, referring to FIG. 1B, in the disclosed embodiment, to create a composite curve, the process at step 130 determines the minimum relative error from a collection of pseudo-phase runs for each realization at a given time step and selects, at step 132, the interpolated pseudo-phase simulated oil rate that corresponds to the minimum relative error to create one or more composite curves. For example, in one embodiment, the minimum error for the collection of pseudo-runs for each realization is determined for each given time step and the rate is determined from the corresponding minimum error.

Figure 9:
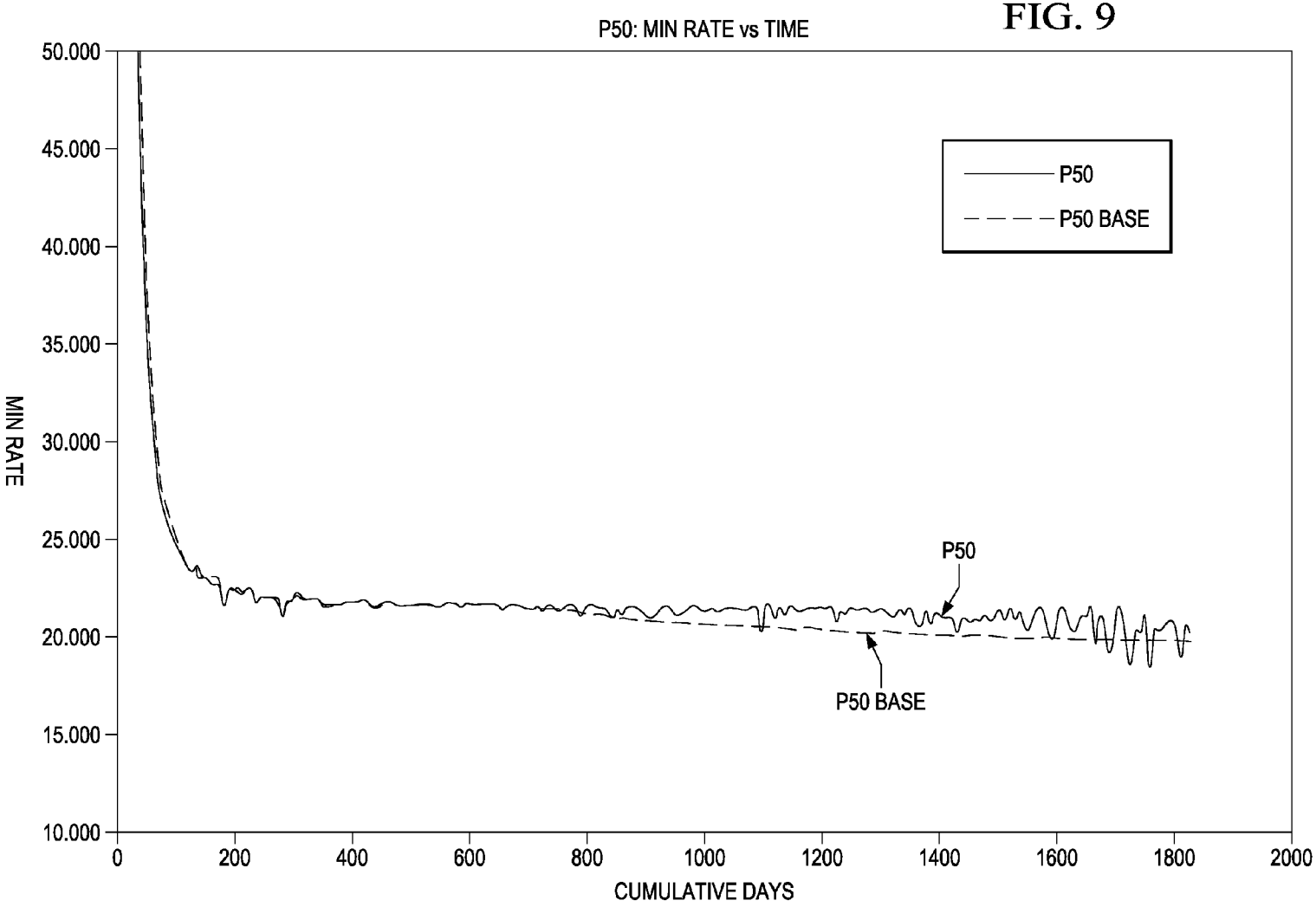
FIG. 9 is an example of a chart that illustrates composite curve with time-interpolated Pseudo-Phase Production rate curves and the historical production rate curve in accordance with the disclosed embodiments.

At step 134, the process determines the best overall match of the actual pseudo-phase production runs and composite rate curves. For example, FIG. 9 provides an example of a composite curve illustrated with the P50 pseudo-phase production rate curve with respect to the base P50. At step 136, the process uses the trapezoid rule or an integral function to calculate the area between the composite oil rate curve and the historical production oil rate curve. In one embodiment, the process selects the historical production oil rate curve that yielded the lowest error for all realizations (e.g., for P90, P50, and P10 realizations).

The process then, at step 138, ranks the realizations by the minimum area under the relative difference curve.

| Oil Rates | | | |
|---|---|---|---|
| | Total Area | | Ranking |
| P10 | 56.046 | P50 | 51.395 |
| P50 | 51.395 | P10 | 56.046 |
| P90 | 68.689 | P90 | 68.689 |

Accordingly, the disclosed embodiments provide an alternative method for performing multiphase flow simulation that uses one or more pseudo-phase single flow relative permeability curves as a proxy for approximating multiphase flow simulation. As can be seen from the above process, the disclosed embodiments provided at least one pseudo-phase production rate result that sufficiently matched historical production data (P50). Additionally, the disclosed embodiments include deriving one or more composite rate curves that may be used for ranking the realizations for oil production rates P50, P90, P10. In the given example, for realization P50, the process correctly identified rates for the correct realization model.

Figure 10:
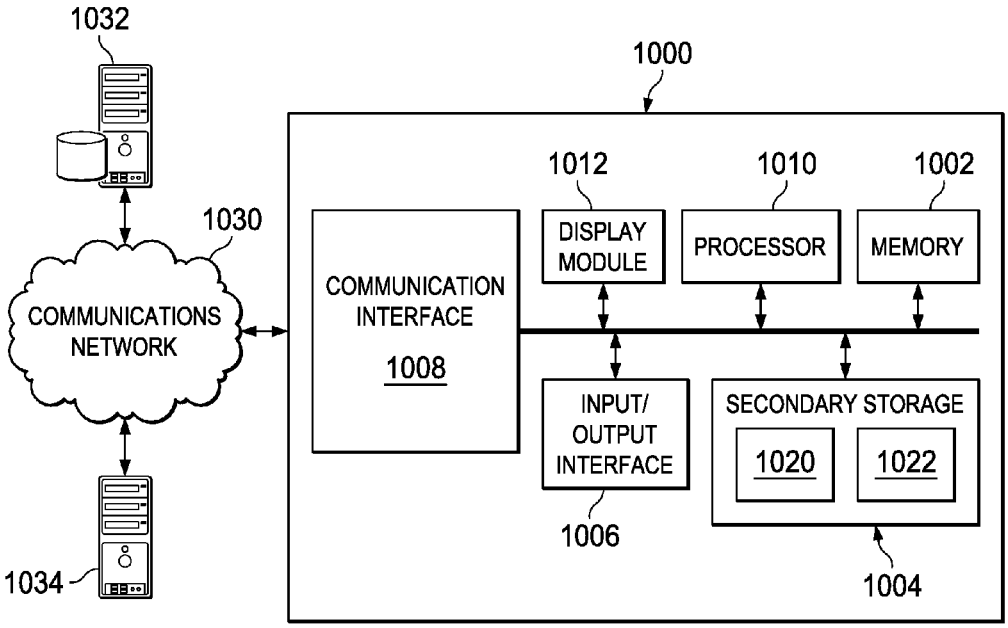
FIG. 10 is a block diagram illustrating one embodiment of a system for implementing the disclosed embodiments.

With reference to FIG. 10, a block diagram illustrating one embodiment of a system 1000 for implementing the features and functions of the disclosed embodiments is presented. The system 1000 includes, among other components, a processor 1010, main memory 1002, secondary storage unit 1004, an input/output interface module 1006, and a communication interface module 1008. The processor 1010 may be any type or any number of single core or multi-core processors capable of executing instructions for performing the features and functions of the disclosed embodiments.

The input/output interface module 1006 enables the system 1000 to receive user input (e.g., from a keyboard and mouse) and output information to one or more devices such as, but not limited to, printers, external data storage devices, and audio speakers. The system 1000 may optionally include a separate display module 1012 to enable information to be displayed on an integrated or external display device. For instance, the display module 1012 may include instructions or hardware (e.g., a graphics card or chip) for providing enhanced graphics, touchscreen, and/or multi-touch functionalities associated with one or more display devices. For example, in one embodiment, the display module 1012 is a NVIDIA® QuadroFX type graphics card that enables viewing and manipulating of three-dimensional objects.

Main memory 1002 is volatile memory that stores currently executing instructions/data or instructions/data that are prefetched for execution. The secondary storage unit 1004 is non-volatile memory for storing persistent data. The secondary storage unit 1004 may be or include any type of data storage component such as a hard drive, a flash drive, or a memory card. In one embodiment, the secondary storage unit 1004 stores the computer executable code/instructions and other relevant data for enabling a user to perform the features and functions of the disclosed embodiments.

For example, in accordance with the disclosed embodiments, the secondary storage unit 1004 may permanently store the executable code/instructions of an algorithm 1020 for approximating multiphase flow reservoir production simulation for ranking multiple petro-physical realizations as described above. The instructions associated with the algorithm 1020 are then loaded from the secondary storage unit 1004 to main memory 1002 during execution by the processor 1010 for performing the disclosed embodiments. In addition, the secondary storage unit 1004 may store other executable code/instructions and data 1022 such as, but not limited to, a reservoir simulation application for use with the disclosed embodiments.

The communication interface module 1008 enables the system 1000 to communicate with the communications network 1030. For example, the network interface module 1008 may include a network interface card and/or a wireless transceiver for enabling the system 1000 to send and receive data through the communications network 1030 and/or directly with other devices.

The communications network 1030 may be any type of network including a combination of one or more of the following networks: a wide area network, a local area network, one or more private networks, the Internet, a telephone network such as the public switched telephone network (PSTN), one or more cellular networks, and wireless data networks. The communications network 1030 may include a plurality of network nodes (not depicted) such as routers, network access points/gateways, switches, DNS servers, proxy servers, and other network nodes for assisting in routing of data/communications between devices.

For example, in one embodiment, the system 1000 may interact with one or more servers 1034 or databases 1032 for performing the features of the present invention. For instance, the system 1000 may query the database 1032 for well log information in accordance with the disclosed embodiments. In one embodiment, the database 1032 may utilize OpenWorks® software available from Landmark Graphics Corporation to effectively manage, access, and analyze a broad range of oilfield project data in a single database. Further, in certain embodiments, the system 1000 may act as a server system for one or more client devices or a peer system for peer to peer communications or parallel processing with one or more devices/computing systems (e.g., clusters, grids).

While specific details about the above embodiments have been described, the above hardware and software descriptions are intended merely as example embodiments and are not intended to limit the structure or implementation of the disclosed embodiments. For instance, although many other internal components of the system 1000 are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media (i.e., a computer program product) include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present invention. It should also be noted that, in some alternative implementations, the functions, instructions, or code noted in a block diagram or illustrated pseudocode may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Accordingly, the disclosed embodiments provide a system, computer program product, and method for approximating multiphase flow reservoir production simulation using a single pseudo-phase flow for ranking multiple petro-physical realizations. In addition to the embodiments described above, many examples of specific combinations are within the scope of the disclosure, some of which are detailed below.

One example is a computer-implemented method, system, or a non-transitory computer readable medium configured to approximate multiphase flow reservoir production simulation for ranking multiple petro-physical realizations by implementing instructions comprising: generating a set of pseudo-phase production relative permeability curves; receiving production rate history data; receiving minimal simulation configuration parameters; performing flow simulation using the set of pseudo-phase production relative permeability curves for a set of petro-physical realizations; determining an optimal matching pseudo-phase production simulation result that best matches the production rate history data; deriving one or more composite rate curves for the set of petro-physical realizations; and determining a ranking for the petro-physical realizations within the set of petro-physical realizations based on an area between a composite rate curve for a petro-physical realization and a historical rate curve. As referenced herein minimal simulation configuration parameters mean simulation configuration parameters that do not include relative permeability data as currently used in standard reservoir simulation. In one embodiment, the petro-physical realizations may include a P90, P50, and P10 realizations.

In addition, with respect to the above example, in determining an optimal matching pseudo-phase production simulation result that best matches the production rate history data, the computer-implemented method, system, or non-transitory computer readable medium may include or implement instructions that performs at least one of computing a correlation coefficient for each pseudo-phase production simulation result relative to the production rate history data and computing a relative error for each pseudo-phase production simulation result relative to the production rate history data across all simulated time to determine a difference between production rate at given instances of time.

Additionally, in the above example embodiment, in deriving the one or more composite rate curves for the set of petro-physical realizations, the computer-implemented method, system, or non-transitory computer readable medium may include or implement instructions that determines a minimum relative error from a collection of pseudo-phases for each petro-physical realization at a given time step and selects an interpolated pseudo-phase simulated oil rate that corresponds to the minimum relative error to derive the one or more composite rate curves.

The above specific example embodiments are not intended to limit the scope of the claims. For instance, the example embodiments may be modified by including, excluding, or combining one or more features, steps, instructions, or functions described in the above example embodiment.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described to explain the principles of the invention and the practical application, and to enable others of ordinary skill in the art to understand the invention for various embodiments with various modifications as are suited to the particular use contemplated. The scope of the claims is intended to broadly cover the disclosed embodiments and any such modification.

The invention claimed is:

1. A computer-implemented method for approximating multiphase flow reservoir production simulation for ranking multiple petro-physical realizations, the method comprising:

generating a set of pseudo-phase production relative permeability curves representing a single phase of a multiphase fluid flow through a subsurface porous medium;

receiving production rate history data;

receiving minimal simulation configuration parameters;

performing flow simulation using each pseudo-phase production relative permeability curve in the set of pseudo-phase production relative permeability curves for a set of petro-physical realizations, based on the minimal simulation configuration parameters;

determining an optimal matching pseudo-phase production simulation result that best matches the production rate history data by:

interpolating pseudo-phase production rate data resulting from the flow simulation for each pseudo-phase production relative permeability curve;

comparing the interpolated pseudo-phase production rate data for each pseudo-phase production relative permeability curve to the production rate history data; and selecting at least one of the pseudo-phase production relative permeability curves as the optimal matching pseudo-phase production simulation result, based on the comparison;

deriving one or more composite rate curves for the set of petro-physical realizations, based on the optimal matching pseudo-phase production simulation result; and determining a ranking for the petro-physical realizations within the set of petro-physical realizations based on an area between at least one of the composite rate curves and a historical rate curve for each petro-physical realization.

2. The computer-implemented method of claim 1, wherein determining an optimal matching pseudo-phase production simulation result that best matches the production rate history data includes computing a correlation coefficient for each pseudo-phase production simulation result relative to the production rate history data.

3. The computer-implemented method of claim 1, wherein determining an optimal matching pseudo-phase production simulation result that best matches the production rate history data includes computing a relative error for each pseudo-phase production simulation result relative to the production rate history data across all simulated time to determine a difference between production rate at given instances of time.

4. The computer-implemented method of claim 1, wherein the set of pseudo-phase production relative permeability curves is a set of step-function relative permeability curves that represent flow of the single phase in the presence of another immobile fluid phase.

5. The computer-implemented method of claim 4, wherein the set of step-function relative permeability curves has cross-over locations at varying points along an original relative permeability curve.

6. The computer-implemented method of claim 1, wherein the set of petro-physical realizations includes a P90, P50, and P10 realizations.

7. The computer-implemented method of claim 1, wherein deriving the one or more composite rate curves for the set of petro-physical realizations includes determining a minimum relative error from a collection of pseudo-phases for each petro-physical realization at a given time step.

8. The computer-implemented method of claim 7, further comprising selecting an interpolated pseudo-phase simulated oil rate that corresponds to the minimum relative error to derive the one or more composite rate curves.

9. A system, comprising:

at least one processor; and at least one memory coupled to the at least one processor and storing computer executable instructions for approximating multiphase flow reservoir production simulation for ranking multiple petro-physical realizations, the computer executable instructions comprises instructions for:

generating a set of pseudo-phase production relative permeability curves representing a single phase of a multiphase fluid flow through a subsurface porous medium;

receiving production rate history data;

receiving minimal simulation configuration parameters;

performing flow simulation using each pseudo-phase production relative permeability curve in the set of pseudo-phase production relative permeability curves for a set of petro-physical realizations, based on the minimal simulation configuration parameters;

determining an optimal matching pseudo-phase production simulation result that best matches the production rate history data by:

interpolating pseudo-phase production rate data resulting from the flow simulation for each pseudo-phase production relative permeability curve;

comparing the interpolated pseudo-phase production rate data for each pseudo-phase production relative permeability curve to the production rate history data; and selecting at least one of the pseudo-phase production relative permeability curves as the optimal matching pseudo-phase production simulation result, based on the comparison;

deriving one or more composite rate curves for the set of petro-physical realizations based on the optimal matching pseudo-phase production simulation result; and determining a ranking for the petro-physical realizations within the set of petro-physical realizations based on an area between at least one of the composite rate curves and a historical rate curve for each petro-physical realization.

10. The system of claim 9, wherein the instructions for determining an optimal matching pseudo-phase production simulation result that best matches the production rate history data includes computing a correlation coefficient for each pseudo-phase production simulation result relative to the production rate history data.

11. The system of claim 9, wherein the instructions for determining an optimal matching pseudo-phase production simulation result that best matches the production rate history data includes computing a relative error for each pseudo-phase production simulation result relative to the production rate history data across all simulated time to determine a difference between production rate at given instances of time.

12. The system of claim 9, wherein the set of pseudo-phase production relative permeability curves is a set of step-function relative permeability curves that represent flow of the single phase in the presence of another immobile fluid phase, the set of step-function relative permeability curves having cross-over locations at varying points along an original relative permeability curve.

13. The system of claim 9, wherein the instructions for deriving the one or more composite rate curves for the set of petro-physical realizations includes determining a minimum relative error from a collection of pseudo-phases for each petro-physical realization at a given time step.

14. The system of claim 13, wherein the instructions for deriving the one or more composite rate curves for the set of petro-physical realizations further includes selecting an interpolated pseudo-phase simulated oil rate that corresponds to the minimum relative error to derive the one or more composite rate curves.

15. A non-transitory computer readable medium comprising computer executable instructions for approximating multiphase flow reservoir production simulation for ranking multiple petro-physical realizations, the computer executable instructions when executed causes one or more machines to perform operations comprising:

generating a set of pseudo-phase production relative permeability curves representing a single phase of a multiphase fluid flow through a subsurface porous medium;

receiving production rate history data;

receiving minimal simulation configuration parameters;

performing flow simulation using each pseudo-phase production relative permeability curve in the set of pseudo-phase production relative permeability curves for a set of petro-physical realizations, based on the minimal simulation configuration parameters;

determining an optimal matching pseudo-phase production simulation result that best matches the production rate history data by:

interpolating pseudo-phase production rate data resulting from the flow simulation for each pseudo-phase production relative permeability curve;

comparing the interpolated pseudo-phase production rate data for each pseudo-phase production relative permeability curve to the production rate history data; and selecting at least one of the pseudo-phase production relative permeability curves as the optimal matching pseudo-phase production simulation result, based on the comparison;

deriving one or more composite rate curves for the set of petro-physical realizations based on the optimal matching pseudo-phase production simulation result; and determining a ranking for the petro-physical realizations within the set of petro-physical realizations based on an area between at least one of the composite rate curves and a historical rate curve for each petro-physical realization.

16. The non-transitory computer readable medium of claim 15, wherein the computer executable instructions when executed further causes the one or more machines to perform operations comprising computing a correlation coefficient for each pseudo-phase production simulation result relative to the production rate history data.

17. The non-transitory computer readable medium of claim 15, wherein the computer executable instructions when executed further causes the one or more machines to perform operations comprising computing a relative error for each pseudo-phase production simulation result relative to the production rate history data across all simulated time to determine a difference between production rate at given instances of time.

18. The non-transitory computer readable medium of claim 15, wherein the set of petro-physical realizations includes a P90, P50, and P10 realizations.

19. The non-transitory computer readable medium of claim 15, wherein the computer executable instructions when executed further causes the one or more machines to perform operations comprising deriving the one or more composite rate curves for the set of petro-physical realizations includes determining a minimum relative error from a collection of pseudo-phases for each petro-physical realization at a given time step.

20. The non-transitory computer readable medium of claim 19, wherein the computer executable instructions when executed further causes the one or more machines to perform operations comprising selecting an interpolated pseudo-phase simulated oil rate that corresponds to the minimum relative error to derive the one or more composite rate curves.

* * * * *